US009320096B2

(12) United States Patent
Peng

(10) Patent No.: US 9,320,096 B2
(45) Date of Patent: Apr. 19, 2016

(54) LIGHT EMITTING DIODE SYSTEM

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 60 days.

(21) Appl. No.: 14/190,603

(22) Filed: Feb. 26, 2014

(65) Prior Publication Data

US 2015/0245435 A1 Aug. 27, 2015

(51) Int. Cl.
*H05B 33/08* (2006.01)

(52) U.S. Cl.
CPC ..... *H05B 33/0821* (2013.01); *H05B 33/0803* (2013.01); *H05B 33/0806* (2013.01); *H05B 33/0809* (2013.01); *H05B 33/0842* (2013.01); *H05B 33/0845* (2013.01); *H05B 33/0857* (2013.01)

(58) Field of Classification Search
CPC ..... H05B 33/0821; H05B 33/0809; H05B 33/0857; H05B 33/0845; H05B 33/0803; H05B 33/0842
USPC ..... 315/181–186, 193, 291, 185 R, 185 S; 348/370; 700/295
See application file for complete search history.

(56) References Cited

U.S. PATENT DOCUMENTS

| | | | | |
|---|---|---|---|---|
| 2004/0207341 | A1* | 10/2004 | Callahan | 315/291 |
| 2009/0302771 | A1* | 12/2009 | Peng | 315/193 |
| 2010/0235009 | A1* | 9/2010 | Banks et al. | 700/295 |
| 2012/0050606 | A1* | 3/2012 | Debevec et al. | 348/370 |
| 2014/0111101 | A1* | 4/2014 | McRae | 315/186 |

* cited by examiner

*Primary Examiner* — Alexander H Taningco
*Assistant Examiner* — Renan Luque
(74) *Attorney, Agent, or Firm* — Muncy, Geissler, Olds & Lowe, P.C.

(57) ABSTRACT

A light emitting diode system includes a first light emitting diode apparatus and a second light emitting diode apparatus. The first light emitting diode apparatus includes an alternating-current-to-direct-current and light-controlling unit, a plurality of first light emitting diode modules and a first connector. The second light emitting diode apparatus includes a second connector, a signal-converting unit and a plurality of second light emitting diode modules. The first light emitting diode apparatus outputs a drive direct current power and a light-controlling signal to the signal-converting unit through the first connector and the second connector. Therefore, the signal-converting unit is configured to control colors and intensities of the second light emitting diode modules.

10 Claims, 2 Drawing Sheets

LIGHT EMITTING DIODE SYSTEM

BACKGROUND OF THE INVENTION

1. Field of the Invention

The present invention relates to a light emitting diode system, and especially relates to an improved light emitting diode system.

2. Description of the Related Art

Nowadays, the connection types of the light emitting diode lamp strings are separated into two types: the serial-type connection and the parallel-type connection. The light emitting diode lamp strings are widely used for external walls of the building, decoration of trees, signboards, and scenery designing.

The related art light emitting diode lamp strings are commonly employed to be connected in series. Also, the amount of the light emitting diode lamp strings is determined according to the volume of the decorated objects. In addition, the controller of the light emitting diode lamp string can control the light emitting diode lamp string which the controller is arranged in only.

The disadvantage of the related art serial-type light emitting diode lamp string mentioned above is that the related art serial-type light emitting diode lamp strings cannot share an alternating-current-to-direct-current power and control circuit. Therefore, the cost is increasing.

SUMMARY OF THE INVENTION

In order to solve the above-mentioned problems, an object of the present invention is to provide a light emitting diode system.

In order to achieve the object of the present invention mentioned above, the light emitting diode system is applied to an alternating current power supply apparatus. The light emitting diode system includes a first light emitting diode apparatus and a second light emitting diode apparatus. The second light emitting diode apparatus is electrically connected to the first light emitting diode apparatus. The first light emitting diode apparatus includes an alternating-current-to-direct-current and light-controlling unit, a plurality of first light emitting diode modules and a first connector. The alternating-current-to-direct-current and light-controlling unit is electrically connected to the alternating current power supply apparatus. The first light emitting diode modules are electrically connected to each other in series. A first of the first light emitting diode modules is electrically connected to the alternating-current-to-direct-current and light-controlling unit. A last of the first light emitting diode modules is electrically connected to the alternating-current-to-direct-current and light-controlling unit. The first connector is electrically connected to the alternating-current-to-direct-current and light-controlling unit and the last of the first light emitting diode modules. The second light emitting diode apparatus includes a second connector, a signal-converting unit and a plurality of second light emitting diode modules. The second connector is electrically connected to the first connector. The signal-converting unit is electrically connected to the second connector. The second light emitting diode modules are electrically connected to each other in series. A first of the second light emitting diode modules is electrically connected to the signal-converting unit. A last of the second light emitting diode modules is electrically connected to the signal-converting unit. The alternating current power supply apparatus outputs an alternating current power to the alternating-current-to-direct-current and light-controlling unit. The alternating-current-to-direct-current and light-controlling unit converts the alternating current power into a drive direct current power. The alternating-current-to-direct-current and light-controlling unit outputs the drive direct current power and a light-controlling signal to the first of the first light emitting diode modules. Then the drive direct current power and the light-controlling signal are transmitted to the other first light emitting diode modules to control colors and intensities of the first light emitting diode modules. The alternating-current-to-direct-current and light-controlling unit outputs the drive direct current power to the signal-converting unit through the first connector and the second connector. The last of the first light emitting diode modules outputs the light-controlling signal to the signal-converting unit through the first connector and the second connector. The signal-converting unit outputs the drive direct current power and the light-controlling signal to the first of the second light emitting diode modules after the signal-converting unit processes the drive direct current power and the light-controlling signal. Then the drive direct current power and the light-controlling signal are transmitted to the other second light emitting diode modules to control colors and intensities of the second light emitting diode modules.

The efficiency of the present invention is that a plurality of light emitting diode lamp strings can be electrically connected to each other in series efficiently, and can share an alternating-current-to-direct-current circuit to save cost.

DETAILED DESCRIPTION OF THE INVENTION

Figure 1:
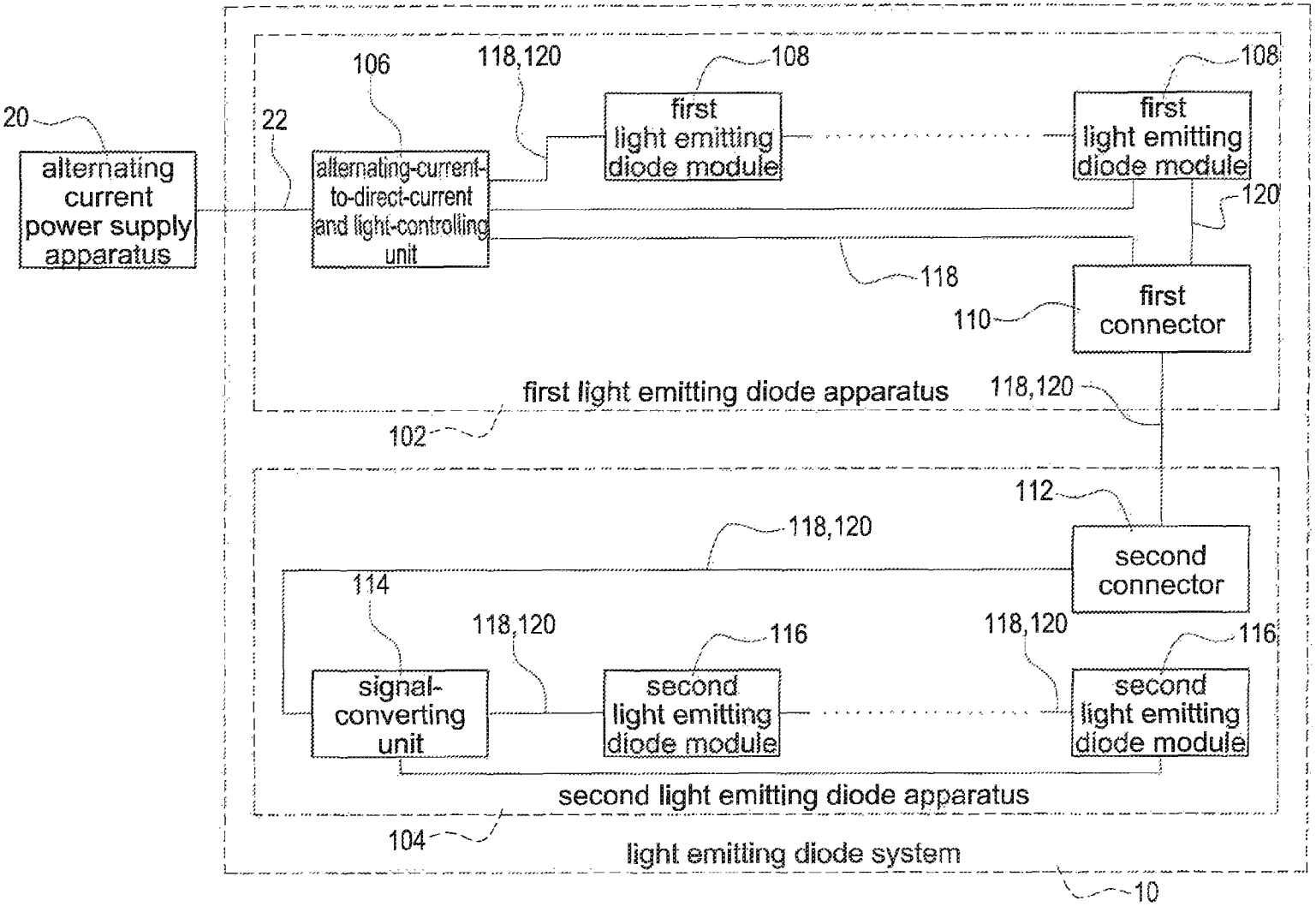
FIG. 1 shows a block diagram of a first embodiment of the light emitting diode system of the present invention.

FIG. 1 shows a block diagram of a first embodiment of the light emitting diode system of the present invention. A light emitting diode system 10 is applied to an alternating current power supply apparatus 20. The light emitting diode system 10 includes a first light emitting diode apparatus 102 and a second light emitting diode apparatus 104. The second light emitting diode apparatus 104 is electrically connected to the first light emitting diode apparatus 102.

The first light emitting diode apparatus 10 includes an alternating-current-to-direct-current and light-controlling unit 106, a plurality of first light emitting diode modules 108 and a first connector 110. The alternating-current-to-direct-current and light-controlling unit 106 is electrically connected to the alternating current power supply apparatus 20. The first light emitting diode modules 108 are electrically connected to each other in series. A first of the first light emitting diode modules 108 is electrically connected to the alternating-current-to-direct-current and light-controlling unit 106. A last of the first light emitting diode modules 108 is electrically connected to the alternating-current-to-direct-current and light-controlling unit 106. The first connector 110 is electrically connected to the alternating-current-to-direct-current and light-controlling unit 106 and the last of the first light emitting diode modules 108.

The second light emitting diode apparatus 104 includes a second connector 112, a signal-converting unit 114 and a plurality of second light emitting diode modules 116. The second connector 112 is electrically connected to the first connector 110. The signal-converting unit 114 is electrically connected to the second connector 112. The second light emitting diode modules 116 are electrically connected to each other in series. A first of the second light emitting diode modules 116 is electrically connected to the signal-converting unit 114. A last of the second light emitting diode modules 116 is electrically connected to the signal-converting unit 114.

The alternating current power supply apparatus 20 outputs an alternating current power 22 to the alternating-current-to-direct-current and light-controlling unit 106. The alternating-current-to-direct-current and light-controlling unit 106 converts the alternating current power 22 into a drive direct current power 118. The alternating-current-to-direct-current and light-controlling unit 106 outputs the drive direct current power 118 and a light-controlling signal 120 to the first of the first light emitting diode modules 108. Then the drive direct current power 118 and the light-controlling signal 120 are transmitted to the other first light emitting diode modules 108 to control colors and intensities of the first light emitting diode modules 108.

The alternating-current-to-direct-current and light-controlling unit 106 outputs the drive direct current power 118 to the signal-converting unit 114 through the first connector 110 and the second connector 112. The last of the first light emitting diode modules 108 outputs the light-controlling signal 120 to the signal-converting unit 114 through the first connector 110 and the second connector 112. The signal-converting unit 114 outputs the drive direct current power 118 and the light-controlling signal 120 to the first of the second light emitting diode modules 116 after the signal-converting unit 114 processes the drive direct current power 118 and the light-controlling signal 120. Then the drive direct current power 118 and the light-controlling signal 120 are transmitted to the other second light emitting diode modules 116 to control colors and intensities of the second light emitting diode modules 116.

Figure 2:
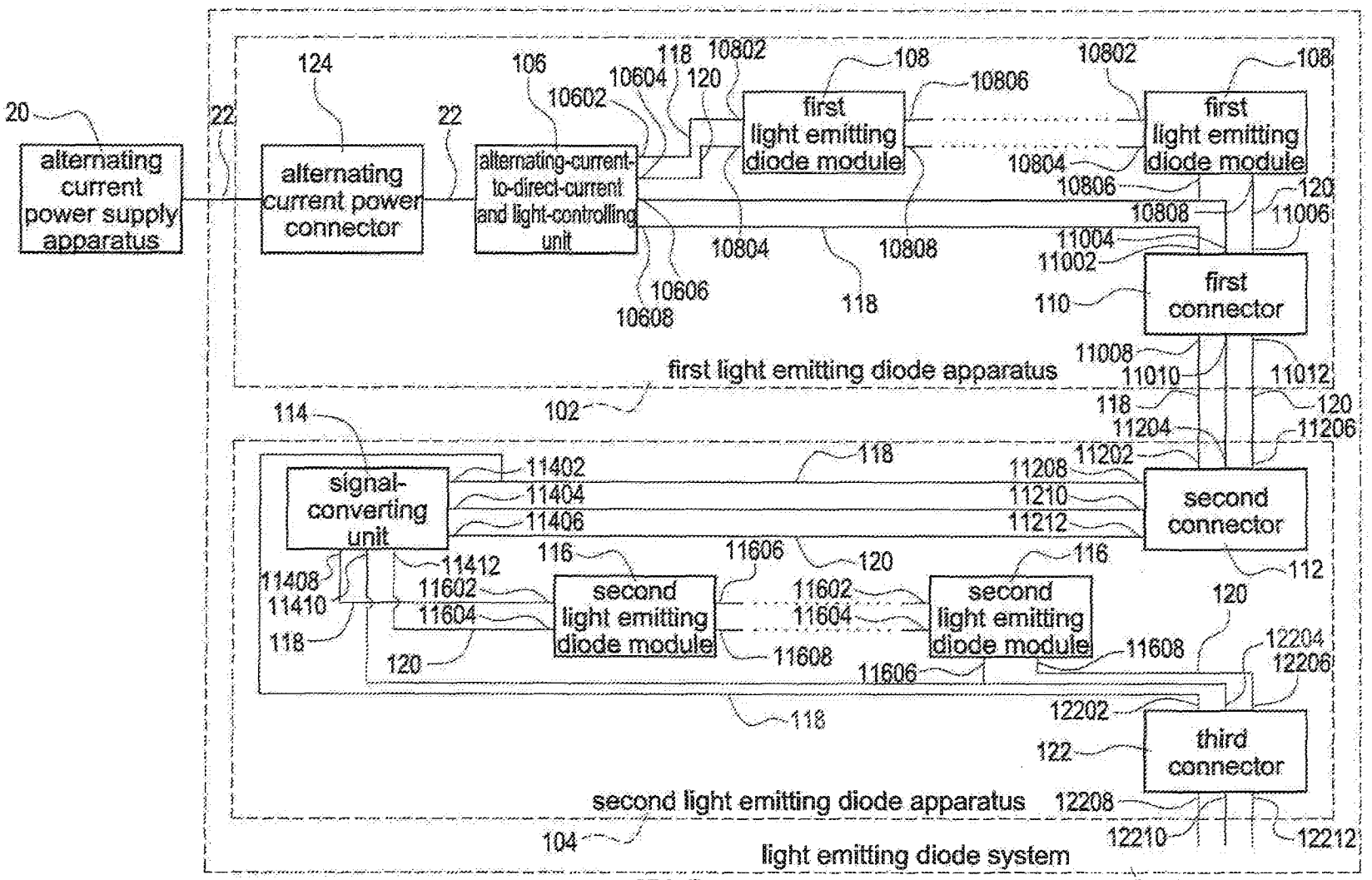
FIG. 2 shows a block diagram of a second embodiment of the light emitting diode system of the present invention.

FIG. 2 shows a block diagram of a second embodiment of the light emitting diode system of the present invention. The description for the elements shown in FIG. 2, which are similar to those shown in FIG. 1, is not repeated here for brevity. Moreover, the second light emitting diode apparatus 104 further includes a third connector 122. The third connector 122 is electrically connected to the signal-converting unit 114, the second connector 112 and the last of the second light emitting diode modules 116. The alternating-current-to-direct-current and light-controlling unit 106 outputs the drive direct current power 118 to the third connector 122 through the first connector 110 and the second connector 112. The last of the second light emitting diode modules 116 outputs the light-controlling signal 120 to the third connector 122.

The first light emitting diode apparatus 102 further includes an alternating current power connector 124. The alternating current power connector 124 is electrically connected to the alternating current power supply apparatus 20 and the alternating-current-to-direct-current and light-controlling unit 106.

The alternating-current-to-direct-current and light-controlling unit 106 includes a positive voltage contact 10602, a data output contact 10604, a negative voltage contact 10606 and a direct current power supply contact 10608. The positive voltage contact 10602 outputs the drive direct current power 118. The data output contact 10604 outputs the light-controlling signal 120. The direct current power supply contact 10608 outputs the drive direct current power 118.

The first light emitting diode module 108 includes a first positive voltage contact 10802, a first data input contact 10804, a first negative voltage contact 10806 and a first data output contact 10808. The first positive voltage contact 10802 of the first of the first light emitting diode modules 108 is electrically connected to the positive voltage contact 10602. The first positive voltage contacts 10802 of the other first light emitting diode modules 108 are electrically connected to the first negative voltage contacts 10806 of a previous of the first light emitting diode modules 108. The first positive voltage contact 10802 outputs the drive direct current power 118.

The first data input contact 10804 of the first of the first light emitting diode modules 108 is electrically connected to the data output contact 10604. The first data input contacts 10804 of the other first light emitting diode modules 108 are electrically connected to the first data output contacts 10808 of the previous of the first light emitting diode modules 108. The first data input contact 10804 is used for inputting the light-controlling signal 120.

The first negative voltage contact 10806 of the last of the first light emitting diode modules 108 is electrically connected to the negative voltage contact 10606 and the first connector 110. The first negative voltage contacts 10806 of the other first light emitting diode modules 108 are electrically connected to the first positive voltage contacts 10802 of a next of the first light emitting diode modules 108.

The first data output contact 10808 of the last of the first light emitting diode modules 108 is electrically connected to the first connector 110. The first data output contacts 10808 of the other first light emitting diode modules 108 are electrically connected to the first data input contacts 10804 of the next of the first light emitting diode modules 108. The first data output contact 10808 outputs the light-controlling signal 120.

The first connector 110 includes a first connector direct current power input contact 11002, a first connector negative voltage input contact 11004, a first connector data input contact 11006, a first connector direct current power output contact 11008, a first connector negative voltage output contact 11010 and a first connector data output contact 11012.

The first connector direct current power input contact 11002 is electrically connected to the direct current power supply contact 10608. The first connector direct current power input contact 11002 is used for inputting the drive direct current power 118. The first connector negative voltage input contact 11004 is electrically connected to the negative voltage contact 10606 and the first negative voltage contact 10806 of the last of the first light emitting diode modules 108. The first connector data input contact 11006 is electrically connected to the first data output contact 10808 of the last of the first light emitting diode modules 108. The first connector data input contact 11006 is used for inputting the light-controlling signal 120.

The first connector direct current power output contact 11008 is electrically connected to the first connector direct current power input contact 11002. The first connector direct current power output contact 11008 outputs the drive direct current power 118. The first connector negative voltage output contact 11010 is electrically connected to the first connector negative voltage input contact 11004. The first connector data output contact 11012 is electrically connected to the first connector data input contact 11006. The first connector data output contact 11012 outputs the light-controlling signal 120.

The second connector 112 includes a second connector direct current power input contact 11202, a second connector negative voltage input contact 11204, a second connector data input contact 11206, a second connector direct current power output contact 11208, a second connector negative voltage output contact 11210 and a second connector data output contact 11212.

The second connector direct current power input contact 11202 is electrically connected to the first connector direct current power output contact 11008. The second connector direct current power input contact 11202 is used for inputting the drive direct current power 118. The second connector negative voltage input contact 11204 is electrically connected to the first connector negative voltage output contact 11010. The second connector data input contact 11206 is electrically connected to the first connector data output contact 11012. The second connector data input contact 11206 is used for inputting the light-controlling signal 120.

The second connector direct current power output contact 11208 is electrically connected to the second connector direct current power input contact 11202. The second connector direct current power output contact 11208 outputs the drive direct current power 118. The second connector negative voltage output contact 11210 is electrically connected to the second connector negative voltage input contact 11204. The second connector data output contact 11212 is electrically connected to the second connector data input contact 11206. The second connector data output contact 11212 outputs the light-controlling signal 120.

The signal-converting unit 114 includes a control side direct current power input contact 11402, a control side negative voltage input contact 11404, a control side data input contact 11406, a control side direct current power output contact 11408, a control side negative voltage output contact 11410 and a control side data output contact 11412.

The control side direct current power input contact 11402 is electrically connected to the second connector direct current power output contact 11208. The control side direct current power input contact 11402 is used for inputting the drive direct current power 118. The control side negative voltage input contact 11404 is electrically connected to the second connector negative voltage output contact 11210. The control side data input contact 11406 is electrically connected to the second connector data output contact 11212. The control side data input contact 11406 is used for inputting the light-controlling signal 120.

The control side direct current power output contact 11408 is electrically connected to the first of the second light emitting diode modules 116. The control side direct current power output contact 11408 outputs the drive direct current power 118. The control side negative voltage output contact 11410 is electrically connected to the control side negative voltage input contact 11404. The control side data output contact 11412 is electrically connected to the first of the second light emitting diode modules 116. The control side data output contact 11412 outputs the light-controlling signal 120.

The second light emitting diode module 116 includes a second positive voltage contact 11602, a second data input contact 11604, a second negative voltage contact 11606 and a second data output contact 11608.

The second positive voltage contact 11602 of the first of the second light emitting diode modules 116 is electrically connected to the control side direct current power output contact 11408. The second positive voltage contacts 11602 of the other second light emitting diode modules 116 are electrically connected to the second negative voltage contacts 11606 of a previous of the second light emitting diode modules 116. The second positive voltage contact 11602 is used for inputting the drive direct current power 118.

The second data input contact 11604 of the first of the second light emitting diode modules 116 is electrically connected to the control side data output contact 11412. The second data input contacts 11604 of the other second light emitting diode modules 116 are electrically connected to the second data output contacts 11608 of the previous of the second light emitting diode modules 116. The second data input contact 11604 is used for inputting the light-controlling signal 120.

The second negative voltage contact 11606 of the last of the second light emitting diode modules 116 is electrically connected to the control side negative voltage output contact 11410 and the third connector 122. The second negative voltage contacts 11606 of the other second light emitting diode modules 116 are electrically connected to the second positive voltage contact 11602 of a next of the second light emitting diode modules 116.

The second data output contact 11608 of the last of the second light emitting diode modules 116 is electrically connected to the third connector 122. The second data output contacts 11608 of the other second light emitting diode modules 116 are electrically connected to the second data input contact 11604 of the next of the second light emitting diode modules 116. The second data output contact 11608 outputs the light-controlling signal 120.

The third connector 122 includes a third connector direct current power input contact 12202, a third connector negative voltage input contact 12204, a third connector data input contact 12206, a third connector direct current power output contact 12208, a third connector negative voltage output contact 12210 and a third connector data output contact 12212.

The third connector direct current power input contact 12202 is electrically connected to the second connector direct current power output contact 11208 and the control side direct current power input contact 11402. The third connector direct current power input contact 12202 is used for inputting the drive direct current power 118. The third connector negative voltage input contact 12204 is electrically connected to the control side negative voltage output contact 11410 and the second negative voltage contact 11606 of the last of the second light emitting diode modules 116. The third connector data input contact 12206 is electrically connected to the second data output contact 11608 of the last of the second light emitting diode modules 116. The third connector data input contact 12206 is used for inputting the light-controlling signal 120.

The third connector direct current power output contact 12208 is electrically connected to the third connector direct current power input contact 12202. The third connector direct current power output contact 12208 outputs the drive direct current power 118. The third connector negative voltage output contact 12210 is electrically connected to the third connector negative voltage input contact 12204. The third connector data output contact 12212 is electrically connected to the third connector data input contact 12206. The third connector data output contact 12212 outputs the light-controlling signal 120.

In an embodiment, the light emitting diode system 10 includes a plurality of the second light emitting diode apparatuses 104. The second connector 112 of a second of the second light emitting diode apparatuses 104 is electrically connected to the third connector 122 of a first of the second light emitting diode apparatuses 104. The second connector 112 of a third of the second light emitting diode apparatuses 104 is electrically connected to the third connector 122 of the second of the second light emitting diode apparatuses 104, and so on.

Moreover, the first light emitting diode module 108 (or the second light emitting diode module 116) includes, for examples but not limited to, at least a light emitting diode and an external driver circuit, or includes a light emitting diode which includes a driver IC.

The advantage of the present invention is that a plurality of light emitting diode lamp strings can be electrically connected to each other in series efficiently, and can share an alternating-current-to-direct-current circuit to save cost.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode system applied to an alternating current power supply apparatus, the light emitting diode system comprising:

a first light emitting diode apparatus; and a second light emitting diode apparatus electrically connected to the first light emitting diode apparatus, wherein the first light emitting diode apparatus comprises:

an alternating-current-to-direct-current and light-controlling unit electrically connected to the alternating current power supply apparatus;

a plurality of first light emitting diode modules electrically connected to each other in series, a first of the first light emitting diode modules electrically connected to the alternating-current-to-direct-current and light-controlling unit, a last of the first light emitting diode modules electrically connected to the alternating-current-to-direct-current and light-controlling unit; and a first connector electrically connected to the alternating-current-to-direct-current and light-controlling unit and the last of the first light emitting diode modules, and arranged after the last of the first light emitting diode modules, wherein the second light emitting diode apparatus comprises:

a second connector connected to the first connector;

a signal-converting unit arranged after the second connector and electrically connected to the second connector; and a plurality of second light emitting diode modules electrically connected to each other in series and arranged after the signal-converting unit, a first of the second light emitting diode modules electrically connected to the signal-converting unit, a last of the second light emitting diode modules electrically connected to the signal-converting unit, wherein the alternating current power supply apparatus outputs an alternating current power to the alternating-current-to-direct-current and light-controlling unit; the alternating-current-to-direct-current and light-controlling unit converts the alternating current power into a first drive direct current power; the alternating-current-to-direct-current and light-controlling unit outputs the first drive direct current power and a light-controlling signal to the first of the first light emitting diode modules; then the first drive direct current power and the light-controlling signal are transmitted to the other first light emitting diode modules to control colors and intensities of the first light emitting diode modules;

wherein the alternating-current-to-direct-current and light-controlling unit further independently outputs a second drive direct current power to the first connector; the last of the first light emitting diode modules sends the light-controlling signal to the first connector; the first connector sends the second drive direct current power and the light-controlling signal received by the first connector to the second connector, and then the second connector outputs the second drive direct current power and the light-controlling signal to the signal-converting unit; the signal-converting unit outputs the second drive direct current power and the light-controlling signal to the first of the second light emitting diode modules; then the second drive direct current power and the light-controlling signal are transmitted to the other second light emitting diode modules to control colors and intensities of the second light emitting diode modules; and wherein the first light emitting diode apparatus is connected to the second connector through the first connector, and then is connected to the second light emitting diode apparatus in series through the second connector.

2. The light emitting diode system in claim 1, wherein the second light emitting diode apparatus further comprises:

a third connector electrically connected to the signal-converting unit, the second connector and the last of the second light emitting diode modules, wherein the alternating-current-to-direct-current and light-controlling unit outputs the second drive direct current power to the third connector through the first connector and the second connector.

3. The light emitting diode system in claim 2, wherein the first light emitting diode apparatus further comprises:

an alternating current power connector electrically connected to the alternating current power supply apparatus and the alternating-current-to-direct-current and light-controlling unit.

4. The light emitting diode system in claim 3, wherein the alternating-current-to-direct-current and light-controlling unit comprises a positive voltage contact, a data output contact, a negative voltage contact and a direct current power supply contact; the positive voltage contact outputs the first drive direct current power; the data output contact outputs the light-controlling signal; the direct current power supply contact outputs the second drive direct current power.

5. The light emitting diode system in claim 4, wherein the first light emitting diode module comprises a first positive voltage contact, a first data input contact, a first negative voltage contact and a first data output contact;

wherein the first positive voltage contact of the first of the first light emitting diode modules is electrically connected to the positive voltage contact; the first positive voltage contacts of the other first light emitting diode modules are electrically connected to the first negative voltage contacts of a previous of the first light emitting diode modules; the first positive voltage contact outputs the first drive direct current power;

wherein the first data input contact of the first of the first light emitting diode modules is electrically connected to the data output contact; the first data input contacts of the other first light emitting diode modules are electrically connected to the first data output contacts of the previous of the first light emitting diode modules; the first data input contact is used for inputting the light-controlling signal;

wherein the first negative voltage contact of the last of the first light emitting diode modules is electrically connected to the negative voltage contact and the first connector; the first negative voltage contacts of the other first light emitting diode modules are electrically connected to the first positive voltage contacts of a next of the first light emitting diode modules;

wherein the first data output contact of the last of the first light emitting diode modules is electrically connected to the first connector; the first data output contacts of the other first light emitting diode modules are electrically connected to the first data input contacts of the next of the first light emitting diode modules; the first data output contact outputs the light-controlling signal.

6. The light emitting diode system in claim 5, wherein the first connector comprises:

a first connector direct current power input contact electrically connected to the direct current power supply contact, the first connector direct current power input contact used for inputting the second drive direct current power;

a first connector negative voltage input contact electrically connected to the negative voltage contact and the first negative voltage contact of the last of the first light emitting diode modules;

a first connector data input contact electrically connected to the first data output contact of the last of the first light emitting diode modules, the first connector data input contact used for inputting the light-controlling signal;

a first connector direct current power output contact electrically connected to the first connector direct current power input contact, the first connector direct current power output contact outputting the second drive direct current power;

a first connector negative voltage output contact electrically connected to the first connector negative voltage input contact; and a first connector data output contact electrically connected to the first connector data input contact, the first connector data output contact outputting the light-controlling signal.

7. The light emitting diode system in claim 6, wherein the second connector comprises:

a second connector direct current power input contact electrically connected to the first connector direct current power output contact, the second connector direct current power input contact used for inputting the second drive direct current power;

a second connector negative voltage input contact electrically connected to the first connector negative voltage output contact;

a second connector data input contact electrically connected to the first connector data output contact, the second connector data input contact used for inputting the light-controlling signal;

a second connector direct current power output contact electrically connected to the second connector direct current power input contact, the second connector direct current power output contact outputting the second drive direct current power;

a second connector negative voltage output contact electrically connected to the second connector negative voltage input contact; and a second connector data output contact electrically connected to the second connector data input contact, the second connector data output contact outputting the light-controlling signal.

8. The light emitting diode system in claim 7, wherein the signal-converting unit comprises:

a control side direct current power input contact electrically connected to the second connector direct current power output contact, the control side direct current power input contact used for inputting the second drive direct current power;

a control side negative voltage input contact electrically connected to the second connector negative voltage output contact;

a control side data input contact electrically connected to the second connector data output contact, the control side data input contact used for inputting the light-controlling signal;

a control side direct current power output contact electrically connected to the first of the second light emitting diode modules, the control side direct current power output contact outputting the second drive direct current power;

a control side negative voltage output contact electrically connected to the control side negative voltage input contact; and a control side data output contact electrically connected to the first of the second light emitting diode modules, the control side data output contact outputting the light-controlling signal.

9. The light emitting diode system in claim 8, wherein the second light emitting diode module comprises a second positive voltage contact, a second data input contact, a second negative voltage contact and a second data output contact;

wherein the second positive voltage contact of the first of the second light emitting diode modules is electrically connected to the control side direct current power output contact; the second positive voltage contacts of the other second light emitting diode modules are electrically connected to the second negative voltage contacts of a previous of the second light emitting diode modules; the second positive voltage contact is used for inputting the second drive direct current power;

wherein the second data input contact of the first of the second light emitting diode modules is electrically connected to the control side data output contact; the second data input contacts of the other second light emitting diode modules are electrically connected to the second data output contacts of the previous of the second light emitting diode modules; the second data input contact is used for inputting the light-controlling signal;

wherein the second negative voltage contact of the last of the second light emitting diode modules is electrically connected to the control side negative voltage output contact and the third connector; the second negative voltage contacts of the other second light emitting diode modules are electrically connected to the second positive voltage contact of a next of the second light emitting diode modules;

wherein the second data output contact of the last of the second light emitting diode modules is electrically connected to the third connector; the second data output contacts of the other second light emitting diode modules are electrically connected to the second data input contact of the next of the second light emitting diode modules; the second data output contact outputs the light-controlling signal.

10. The light emitting diode system in claim 9, wherein the third connector comprises;

a third connector direct current power input contact electrically connected to the second connector direct current power output contact and the control side direct current power input contact, the third connector direct current power input contact used for inputting the second drive direct current power;

a third connector negative voltage input contact electrically connected to the control side negative voltage output contact and the second negative voltage contact of the last of the second light emitting diode modules;

a third connector data input contact electrically connected to the second data output contact of the last of the second light emitting diode modules, the third connector data input contact used for inputting the light-controlling signal;

a third connector direct current power output contact electrically connected to the third connector direct current power input contact, the third connector direct current power output contact outputting the second drive direct current power;

a third connector negative voltage output contact electrically connected to the third connector negative voltage input contact; and a third connector data output contact electrically connected to the third connector data input contact, the third connector data output contact outputting the light-controlling signal.

* * * * *